United States Patent [19]

Bonfilio

[11] Patent Number: 4,625,683

[45] Date of Patent: Dec. 2, 1986

[54] ROTATING CYLINDER INTERNAL COMBUSTION ENGINE

[76] Inventor: Roberto L. Bonfilio, 47-25 198 St., Auburndale, N.Y. 11358

[21] Appl. No.: 723,862

[22] Filed: Apr. 16, 1985

Related U.S. Application Data

[62] Division of Ser. No. 483,602, Apr. 11, 1983.

[51] Int. Cl.[4] ..... F02B 57/00

[52] U.S. Cl. ..... 123/44 R; 91/491; 123/44 C

[58] Field of Search ..... 91/197, 491, 493, 494, 91/495; 123/44 R, 44 C; 60/605

[56] References Cited

U.S. PATENT DOCUMENTS

| | | | |
|---|---|---|---|
| 345,858 | 7/1886 | Poore et al. | 91/493 X |
| 734,237 | 7/1903 | McFarland . | |
| 1,082,569 | 12/1913 | Tift . | |
| 1,114,816 | 10/1914 | Stapp . | |
| 1,508,937 | 9/1924 | Pocock et al. | 91/493 X |
| 1,878,561 | 9/1932 | Wipperman . | |
| 2,665,668 | 1/1954 | Ward | 123/44 C |
| 3,242,870 | 3/1966 | Bush | 91/494 X |
| 3,605,564 | 9/1971 | Shoemaker . | |

FOREIGN PATENT DOCUMENTS

| | | | |
|---|---|---|---|
| 106803 | 12/1899 | Fed. Rep. of Germany | 123/44 R |
| 301715 | 10/1919 | Fed. Rep. of Germany | 123/44 R |
| 2536764 | 3/1977 | Fed. Rep. of Germany . | |
| 393328 | 10/1908 | France . | |
| 468414 | 4/1914 | France | 123/44 C |
| 19254 | 8/1914 | France | 123/44 R |
| 818200 | 7/1937 | France | 91/495 |
| 80/02584 | 11/1980 | PCT Int'l Appl. . | |
| 90208 | 8/1921 | Switzerland | 123/44 R |
| 22820 | of 1912 | United Kingdom | 123/44 R |
| 9716 | of 1913 | United Kingdom | 123/44 C |
| 130414 | 8/1919 | United Kingdom | 123/559 |
| 2110311 | 6/1983 | United Kingdom . | |

*Primary Examiner*—Michael Koczo

*Attorney, Agent, or Firm*—McAulay, Fields, Fisher, Goldstein & Nissen

[57] ABSTRACT

A rotary internal combustion engine having a plurality of radially aligned cylinders collectively supported for common rotation about a shaft member having one portion with a first axis, with a piston block including a piston for each of the cylinders slidable within each cylinder and supported for rotation about the shaft member having another portion with a second axis which is displaced from and parallel to the first axis, the cylinders being linked with the piston block to rotate the cylinders about the first axis with the pistons and the piston block while moving the cylinders transversely of the first axis for rotation of the cylinders and pistons together thereby producing relative reciprocal motion of each piston with respect to its cylinder.

20 Claims, 7 Drawing Figures

ROTATING CYLINDER INTERNAL COMBUSTION ENGINE

This is a division of application Ser. No. 483,602 filed Apr. 11, 1983.

BACKGROUND OF THE INVENTION

This invention relates to a rotary engine. More particularly, the invention is concerned with a rotary engine of the type in which the pistons and associated cylinders rotate together about a pair of displaced axes with the pistons rotating about its own axis which is displaced from the axis of the cylinders.

FIELD OF THE INVENTION

The engine of the invention is of the type in which the pistons and cylinders rotate together.

DESCRIPTION OF THE PRIOR ART

An example of recent work in this area is International Application No. PCT/AU80/00013 filed in Australia on May 15, 1979 having an international filing date of May 15, 1980 and entitled Rotary Radial Internal Combustion Engine. In this engine, the cylinders are rigidly connected to a rotating block and the piston rod oscillates from right to left; the connecting rod is rigidly solid with a rotating block and moves transversely (from right to left) by means of a pin and sleeve bearing. A gudgeon (which is a cantilevered offset pin) is supported and fixed on one side only. In this engine, the cylinder drags the piston in a perpendicular movement to the rotating shaft. Uneven wear of the piston therefore results due to side pressure between the piston and cylinder. Also, considerable sliding friction between the piston pin and connecting rod exists, and the piston rods must withstand a torque or twisting due to the oscillation connection to the piston.

U.S. Pat. No. 734,237 to McFarland, Jr., discloses an engine in which the cylinders are radially mounted and the pistons are connected with an eccentric shaft. The cylinders are pivotally suspended at their outer ends.

U.S. Pat. No. 1,082,569 to Tift discloses pistons carried on an eccentric crank and cylinders which oscillate about a pivot-trunnion such that the pistons are alternately forced into and out of the cylinders. The casing is revolvably mounted on journal members.

U.S. Pat. No. 1,878,561 to Wippermann discloses an eccentric disc to which pistons are connected by means of a pivoting piston rod. The cylinder frame is slowly rotated.

U.S. Pat. No. 1,114,816 to Stapp discloses a rotary engine with cylinders fixed to the housing and rotating therewith, and pistons whose axial centers are offset from the axes of the cylinders. The pistons are carried on piston rods with orthogonally related slotted yokes to provide for the reciprocation within the cylinders as the pistons and cylinders rotate.

U.S. Pat. No. 3,605,564 to Shoemaker is typical of rotary piston devices in which pistons are given rectilinear motion relative to cylinders in which the cylinders rotate about an axis displaced from the axis of rotation of the pistons. This patent discloses link rods which pivot both on the piston and a center wheel carrying or rotating the pistons about the axis displaced from the cylinder axis. The cylinders are fixed and rotate with the housing.

The PCT/AU80/00013 application invented by Richard Gall is an example of the most recent attempt to produce a rotary engine and still has certain drawbacks. In this respect, it is believed that the spark plugs are easily fouled due to centrifugal force. Use is made of a conventional coil and distributor. The intake is obtained through a revolving power shaft into an arcuate conduit and injected into the combustion chamber. Exhaust gases are expelled by an arcuate conduit leading from the exhaust valve to the power shaft and against centrifugal force causing a back pressure.

SUMMARY OF THE INVENTION

A feature of the invention is that the pistons form a solid rotary block which rotates or are connected with a solid block that rotates. The cylinders oscillate from right to left in relation to a housing or a side plate and rotate as a unit with the pistons, while the pistons and the solid block and linkages connected with a plate or plates control the position of the cylinders in relation to their rotation center creating up and down follower movement in relation to the pistons.

Drag on the piston is avoided or substantially reduced because the piston portion or rotary block supporting or carrying the pistons is connected with one set of plates which are connected by means of small cranks to another set of plates supporting the cylinder head, and linkages are provided to assure a constant relative position between the pistons and cylinders, the same for each angular position between the pistons and cylinders as well as maintaining the piston and cylinder rotation together at the same angular speed. The one set of plates have an axis co-axial with the axis of the piston block, and the other set of plates have an axis co-axial with the central axis of the cylinder; and the two axes are displaced from each other.

DESCRIPTION OF THE PREFERRED EMBODIMENTS

Figure 2:
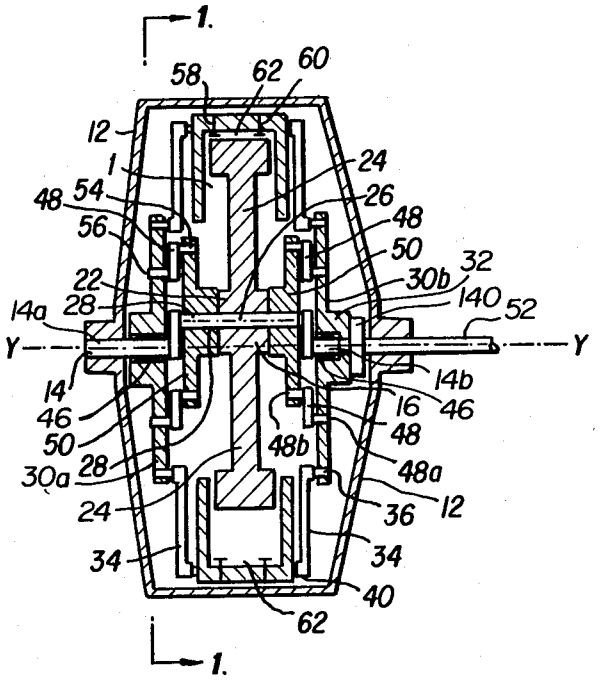
FIG. 2 is a schematic partially sectional view taken on line 2—2 of FIG. 1 in which both axes are coplanar.
Figure 1:
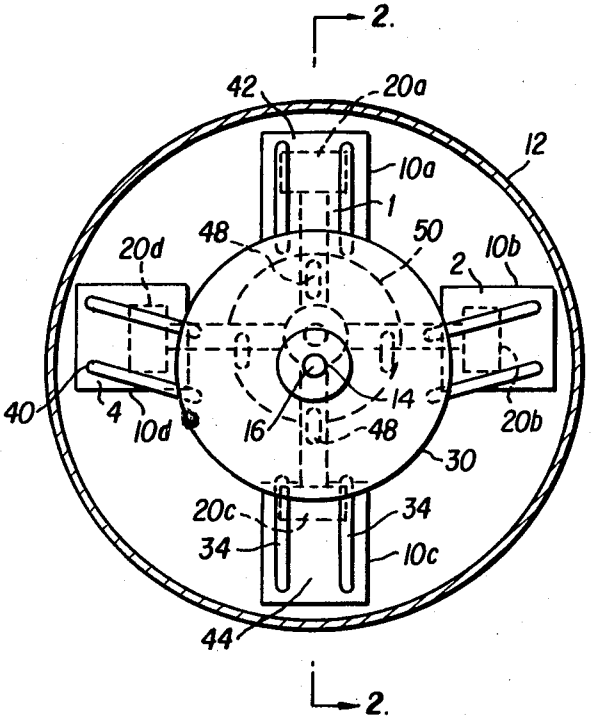
FIG. 1 is a schematic partially sectional view of a preferred embodiment of an engine according to the invention taken on a plane passing through and normal to the axes of the pistons and cylinders, and taken on line 1—1 of FIG. 2.

Referring now in particular to FIGS. 1 and 2 which schematically illustrate the working principles of the rotary engine according to the invention, the engine is shown as a four cylinder engine, although a two or six cylinder or more engine will operate on the same principles.

Four cylinders 10*a, b, c* and *d* are supported within a housing 12 or equivalent support. Housing 12 is fixedly connected with shaft 14 which passes through cylinder axis 16 shown in dashed lines in FIG. 2.

Shaft 14 is an offset crankshaft having a central portion or part 28 connected between and to end parts 14*a* and 14*b*.

Pistons 20*a, b, c* and *d* are each associated with cylinders 10*a, b, c* and *d*, respectively, and are connected with a central piston member or block 22 having a portion 24 acting as a piston rod and rotates about a central portion 28 which is part of shaft 14. Piston block or member 22 rotates about central portion 28 of shaft 14 and has a piston axis passing through central portion 28 and centrally located relative to piston member or block 22 but displaced from a central or cylinder axis 16 passing through end parts 14*a* and 14*b*. The pistons, piston rods and piston member form one solid block. The displacement of the two axes 16 and 26 is determined by the length of the cylinders or depth of the bore thereof and the stroke of the pistons 20 such that the piston-cylinder combination will follow a conventional Otto or Diesel engine.

A pair of spaced cylinder side plates 30 (30*a*, 30*b*) are positioned with cylinders 10 therebetween and rotate together with crank 48 so that the side plates 30 rotate about central or cylinder axis 16. Each cylinder is connected to each side plate with at least one link 34; however, it is preferred that each cylinder be connected by means of two links 34 to each side plate 30 so that four links 34 interconnect each cylinder with the spaced side plates. The cylinders or cylinder head and pistons rotate together or go round together at the same angular velocity so that there is no lateral friction between the pistons and cylinder, and the only friction, if any, is axial as the pistons reciprocate in the cylinders.

Each link 34 has one end connected to side plate 30 by means of a pivot 36 so that the links can pivot on 36. The pivots are equally spaced on opposite sides of the cylinder or central axis 16. The links are all equal in length and the links associated with one particular cylinder and plate are parallel with each other. The cylinder is also provided with pivot 40 to connect the other end of the links to the cylinder; the spacing between the pivots on the cylinder is equal to the spacing between the pivots on the plates so as to assure the longitudinal alignment between the pistons and cylinders.

Each pair of links 34 are parallel and are of the same length and oscillate between points or pivots 36,40 equidistant from each other so that lines connecting the pivots 36 and 40 together as well as lines passing through the links and connecting the pivot 36 to pivot 40 thereof form a parallelogram.

The cylinders 10 rotate around center or cylinder axis 16, and as cylinder 10 rotates 180° from its top position in FIGS. 1 and 2, to its bottom position, the relative position or the distance between the piston and cylinder goes from a minimum 42 to a maximum 44 to create the volume variation in the cylinder in the space between the face of the piston and the top of the cylinder.

To assure the relative angular position between the piston and cylinder, offset connecting pins or cranks 48 are provided which are connected between plates 30*a*, 30*b* and a second pair of spaced plates 50. Plates 50 and 30*a* and 30*b* are connected by means of cranks 48, and plates 50 rotate on central portion 28, and plates 30*a* and 30*b* rotate about portions or parts 14*a* and 14*b* of shaft 14, respectively. Four pins or cranks 48 spaced 90° apart are preferred, although more or less can be used so long as the spacing between each two adjacent pins are the same to maintain the proper balance and to interlock plates 30 and 50. The offset connecting pins or cranks 48 transfers the power output from plates 50 to plates 30 and from plate 30*b* to power output shaft 52.

One plate 30*a* rotates about end part 14*a* of shaft 14 which is fixed to housing 12, and for this purpose bearing 46 (see FIG. 2) is provided to rotatably support the first plate 30*a*. The other plate 30*b* of plates 30 is fixed at fixed connection 32 to output shaft 52 for rotation thereof.

Offset connecting pins 48 are small cranks which have their offset ends 48*a*, 48*b* rotate in bearings 54 and 56 in plates 30 and 50 while at the same time moving plates 30. The orientation of the longitudinal axes of cranks 48 is parallel to the plane of the axes 16 and 26. The second set of plates 50 are carried on and rotate about portion 28 of shaft 14 which passes through the piston block 22, portion 28 has its axis co-axial with piston axis 26. As the piston block 22 rotates, plates 50 which are fixed to the piston block 22 are rotated, and offset connecting pins 48 transfers the rotary movement to plates 30, and from plate 30*b* to output shaft 52 through fixed connection 32.

Convention intake and exhaust valves 58 and 60 may be provided together with a spark plug or piezo-electric crystal 62 to ignite a fuel-air mixture.

Figure 4:
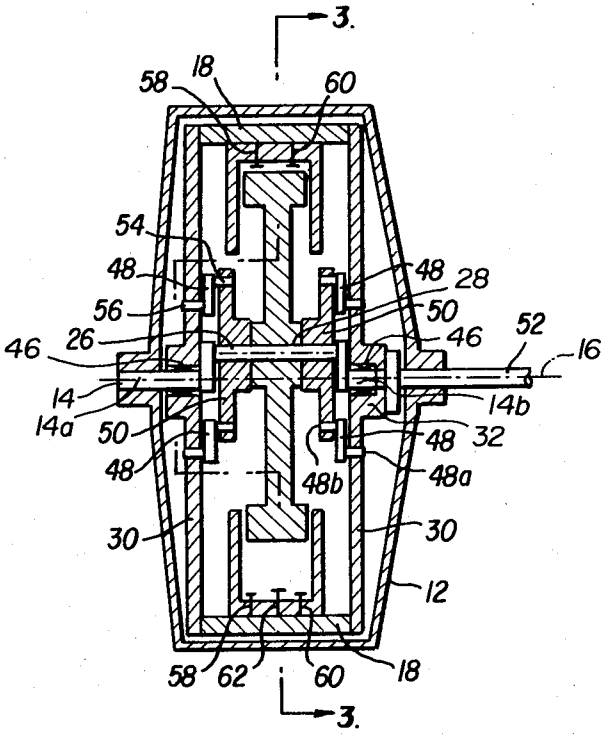
FIG. 4 is a schematic partially sectional view taken on line 3—3 of FIG. 4 in which both axes are coplanar.
Figure 3:
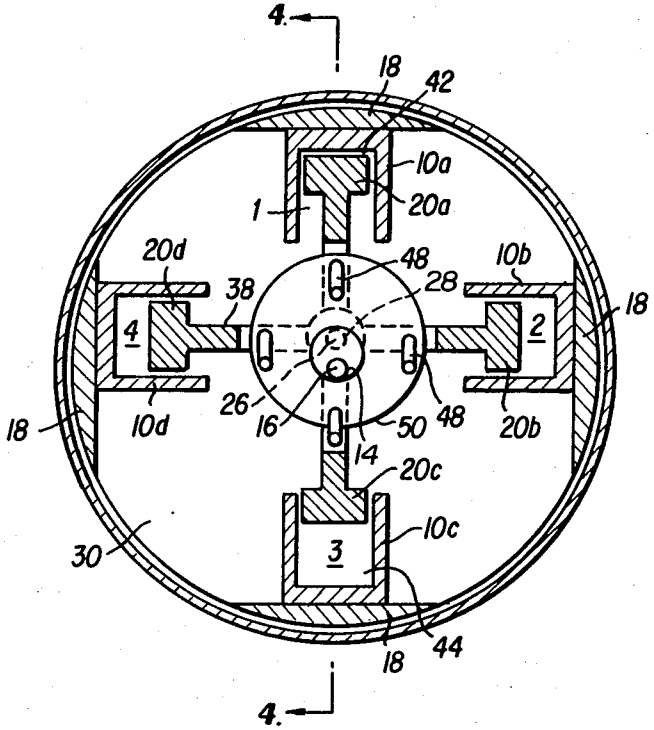
FIG. 3 is a schematic partially sectional view of another embodiment of an engine according to the invention taken on a plane passing through and normal to the axes of the pistons and cylinders, and taken on line 3—3 of FIG. 4.

An alternative embodiment is shown in FIGS. 3 and 4 which uses slides 18 to connect the cylinders with housing 12 while permitting the cylinders to slide in slides 18 to maintain the cylinder axis 16 aligned with the piston axis 26. In this embodiment, links 34 and pivots 36,40 are omitted because the relative relationship between the pistons and associated cylinders is maintained by slides 18.

When slides 18 are used, then one plate 30*a* rotates about shaft 14 at bearing 46, and the other plate 30*b* is fixed with output shaft 52. Here also, the piston block 22 upon rotation thereof by the normal movement of the pistons out of the cylinders rotates plates 50 which in turn rotate plates 30 through their interconnection by offset cranks 48.

Shaft 14 is the main supporting shaft and is fixedly connected with housing 12. Cranks 48 rotate together with plates 30 and 50.

The offset between the central axis passing through offset 48*a* and the central axis passing through offset 48*b* is exactly the same as the spacing between cylinder or central axis 16 and which coincides with the axis of output shaft 52 and piston axis 26 and, of course, the stroke of the piston in the cylinder is twice the spacing between axes 16 and 26 or 48*a* and 48*b* and in effect twice the length of crank 48. The axis passing through each offset is parallel with the others as well as with the piston and cylinder axes. The four offset cranks have their own axis of rotation when they rotate as a group with plates 30 and 50. The axis of rotation of the offset cranks 48 is spaced between axis 16 and axis 26. Therefore, each system, the piston system, the cylinder system and the offset cranks rotate about their own individual axis, and all three axes lie in the same plane. Hence, there is no inertial stress on the pistons nor is there a balancing problem when the pistons rotate so that high R.P.M.'s can be achieved.

Figure 5:
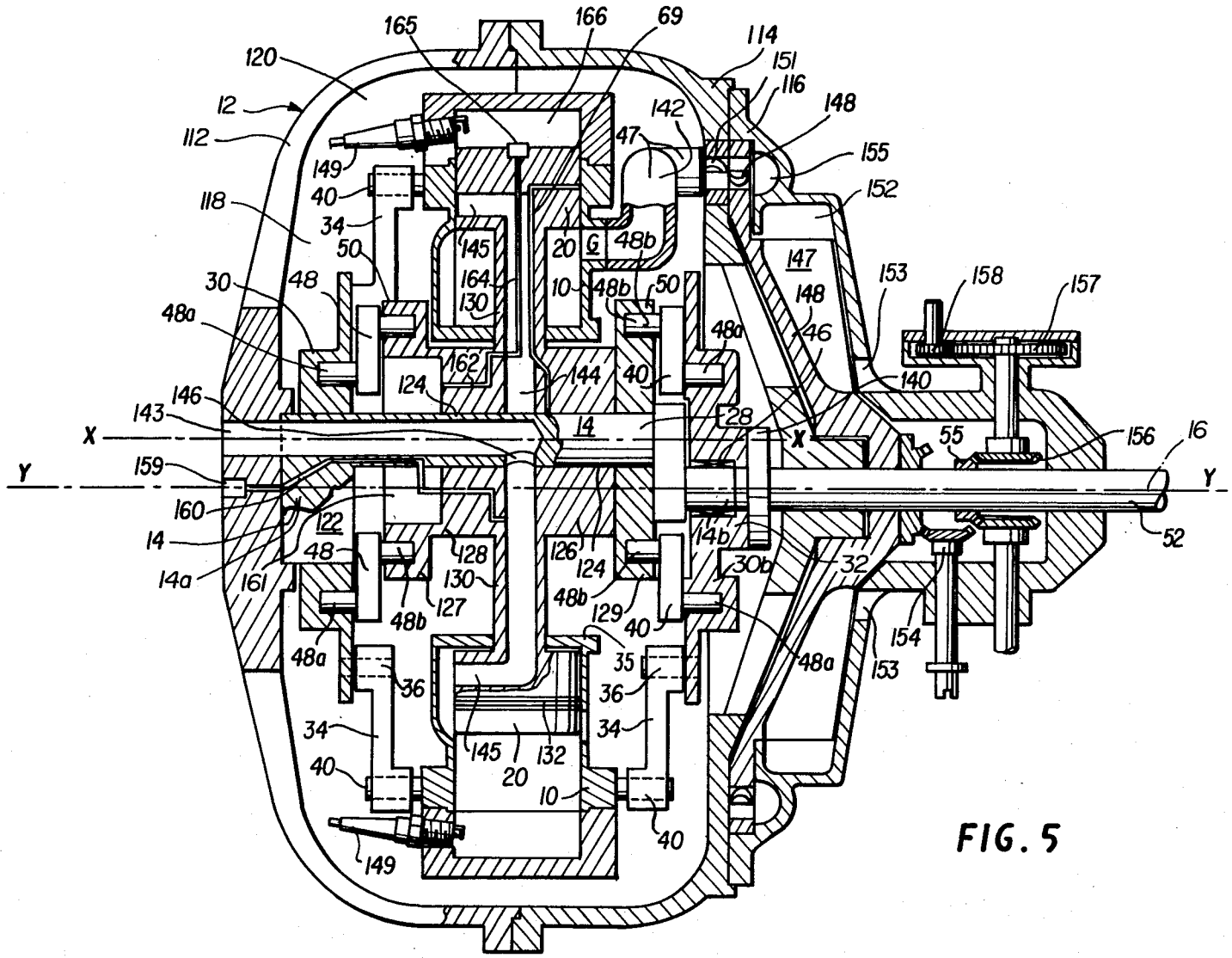
FIG. 5 is a transverse section taken through the central axis of an engine of the type referred to in FIG. 1 with a turbocharger.
Figure 6:
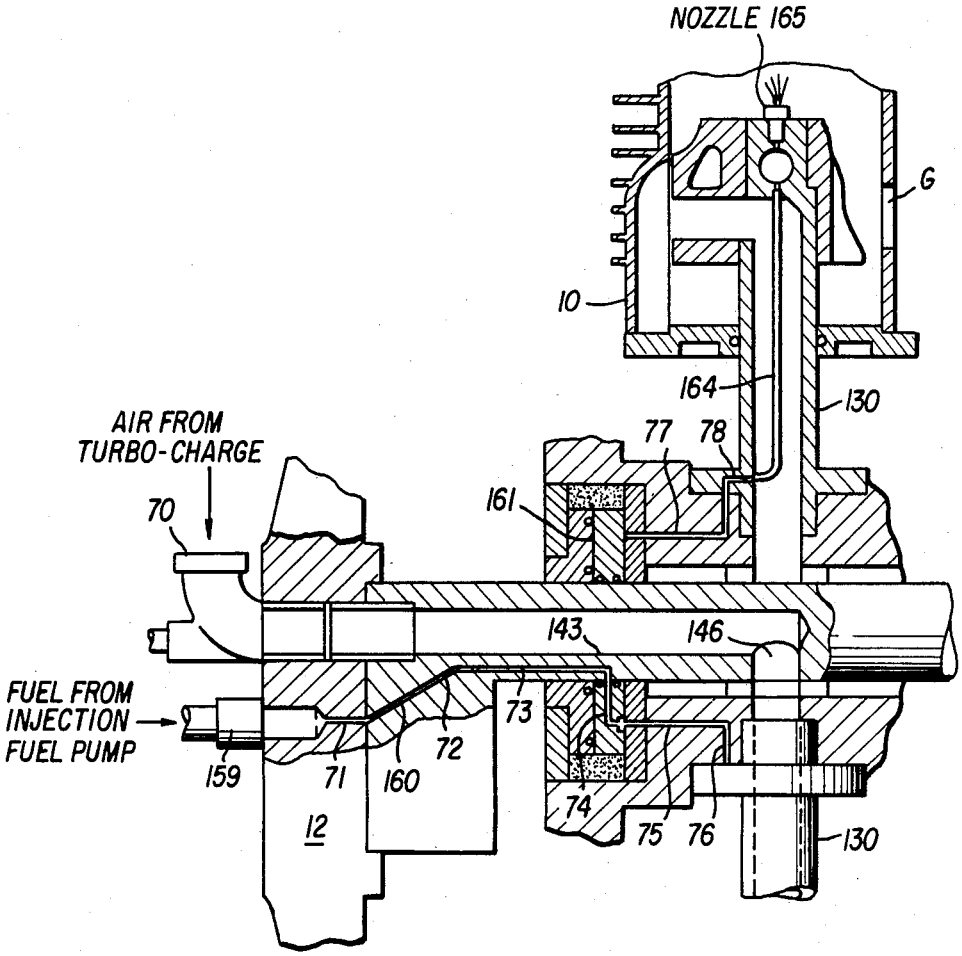
FIG. 6 is an enlarged partial sectional view of a detail of FIG. 5 of an engine employing the principles of the engines of FIGS. 1–5 and showing one form of supplying fuel and air.
Figure 7:
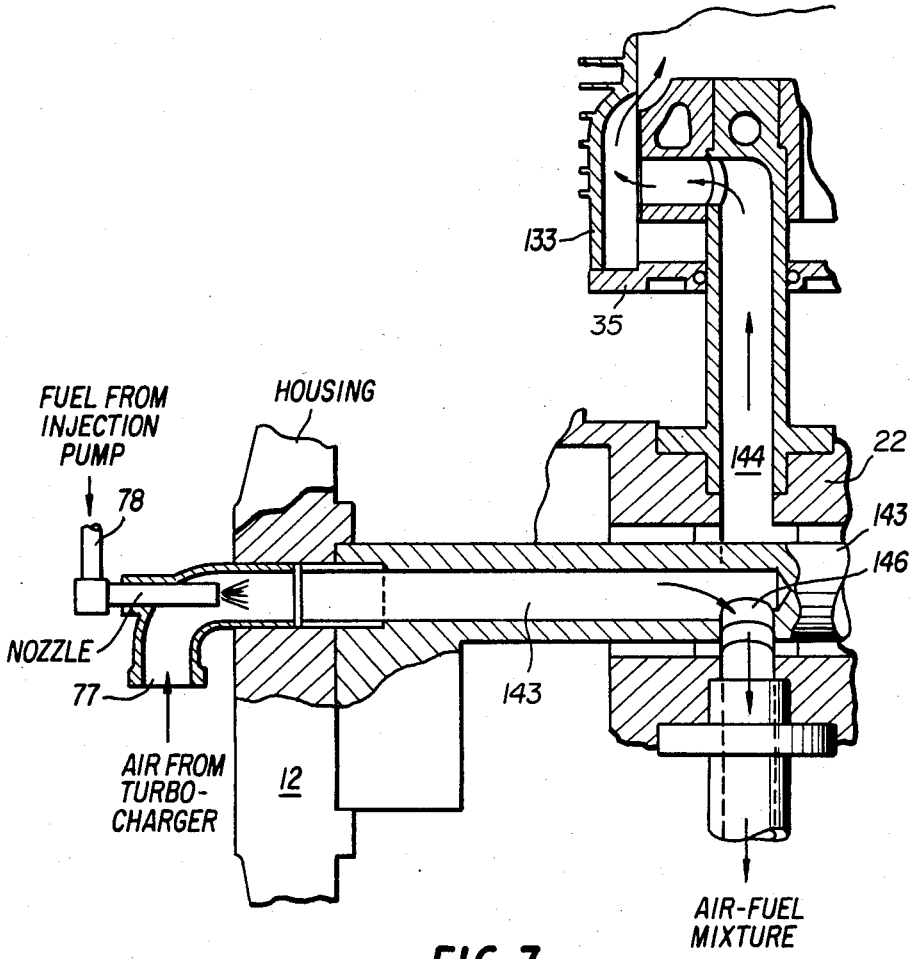
FIG. 7 is a modification of the detail of the engine of FIG. 6 showing another form of supplying an air-fuel mixture.

Referring now to FIGS. 5 to 7 and more particularly to FIG. 5 which illustrates an engine according to the invention of the type schematically shown in FIGS. 1 and 2, with housing 12 formed of housing elements 112, 114, 116 having an interior opening 118 and a conduit 120 axially traversing the housing from front to rear. At the front of housing 12 is an axis Y—Y which coincides with central axis 16. Duct 124 communicates with the outside of housing 12 for supplying air to the motor as will be explained in connection with FIGS. 6 and 7. Rotor 126 carries the pistons 20 and piston block 22 for rotation about axis X—X which coincides with piston block axis 26. Rotor 126 includes a first trunk 127, an intermediate trunk 128 and a final or end trunk 129. Pistons 20 are suitably connected with piston rods 130, and are provided with piston rings 132. The cylinder has its bottom closed by plate 35.

The rotor complex is intermediate the side plates 30 and receives ends 48*a* of the offset cranks 48. Plate 30*b* is solidly connected through flange 140 to output shaft 52.

The offset cranks 48 rotate on bearings mounted in plates 30, and preferably four are provided on each side of the rotor or piston block. As heretofore described, the offset cranks have their own center of rotation.

Air or air-fuel combination compressed in cylinders 10 is exhausted therefrom through port G and then to conduit 142 from the upper part of cylinder 10. And, supply of air or air-fuel combination through conduit 145 then fills the cylinder 10 with air or air-fuel combination for the supply of fresh air or a new air-fuel combination. Air is fed through conduit 143 in the shaft 14, conduit 144 in piston rod 130 and conduit 145. Hole 146 provides entry from conduit 143 to 144. Turbocharger 147 which is activated by turbine 148 feeds turbocharger output or exhaust air to conduit 143 by external means, not shown. Fuel is ignited by a typical spark plug 149. Nozzle 47 is situated on top of the rotating cylinder 10 and oriented so that it is slightly inclined towards the plane of rotation and the power output shaft 52 so that the output gases impinge onto the blades of a deflector 151, so that the turbine 148 operates the turbocharger 147, the compressed air of which is sucked through opening 153 and forcefully blasted into collector 152 and into conduit 143. Deflector 151 is concentric with axis Y—Y and extends circularly concentric with axis Y—Y.

Bevel gear 154 forms a solid unit with turbocharger 147 so that it is driven at the start of the engine and then can be disconnected. A separate electric motor can be used as the starting motor. Combusted gases are collected into collector 155 and then discharged into the atmosphere. Bevel gear 55 is connected with shaft 52 and in turn drives complementary bevel gear 156' to supply movement to auxiliary equipment such as a fuel pump through a spur gear 157.

A fuel pump activated by axle 158 supplies fuel to inlet 159 through an internal passage 160 in shaft 12 to the complex collector distributor 161 to each cylinder by means of internal passageway 162 to a small tube 164 welded inside conduit 144 of the piston rod.

Fuel is forced into nozzle 165 and sprayed or atomized into the combustion chamber 166 where it is ignited by spark plug 149.

FIG. 6 illustrates the injection of fuel directly into the combustion chamber and air is supplied separately; like parts have been numbered with the same numbering as in the previous figures. Air from the turbocharger 147 (FIG. 5) is fed to inlet 70 and fuel from the fuel injection pump is led to inlet 159 to fuel conduit 160 comprising conduit portions 71, 72, 73, 74, 75, 76 and through complex collector distributor 161.

FIG. 7 illustrates how the air and fuel are mixed together in linked conduits designated 143 and 144, and it is noted that like parts have the same reference numerals as in the previous figures. Air from the turbocharger is fed to inlet 77 to combine with fuel from the fuel pump which is fed in at 78 to combine with the air in conduit 143. The arrows show the direction of flow of the fuel and air into the cylinders.

Port G in FIG. 6 is used both as an exhaust and an intake port. The spent fuel escapes through port G into duct 142 through nozzle 47. Port G in FIG. 6 can be used as an exhaust port from 110° to about 250° and as an intake port from 280° to 80° (160°). the spent fuel escapes through port G into deflector 151 and turbine 148. The fresh air rushes in from port G into the bottom part of the cylinder and compressed air into the upper part of the cylinder through the lateral duct of the cylinder.

Fuel can be injected directly into the air supplied by the turbocharger by means of a bypass of the fuel line in conduit 143 which may be atomized through a nozzle situated in a convenient position in the air supplied from the turbocharger and then through passageways or conduits 142, 144 and 145 into the upper chamber of the cylinder. Thus, all passageways 143, 144, 145, 142 could be considered as a manifold when compared to a conventional engine. This type of feeding of fuel through a manifold-like system is considered to be useful when starting a cold engine.

The operation of FIGS. 6 and 7 are substantially alike, and where they differ, the differences will be set forth. In FIG. 6 the air and fuel are mixed in the cylinder, whereas in FIG. 7 the air and fuel are pre-mixed before being applied to the cylinder.

There is one intake and exhaust port G. The bottom of the cylinder is closed off. As the piston comes down air fills the bottom. As the piston continues to go down, air is supplied from the turbocharger into the chamber and then also forces the residual air at the bottom of the cylinder and the port G is closed off, the piston forces air up and around through curved wall 10 and will enter the upper chamber above the piston which creates pressure on the piston and as the piston comes up, the piston now compress the air-fuel mixture (in FIG. 6 fuel is injected and mixed with the air, and in FIG. 7 there is a combined air-fuel mixture fed to the upper chamber). After explosion, the piston comes down and exhausts through port G. As the piston comes down, the opening in port G now serves as an exhaust and the curvature of the upper piston as shown in the drawing varies the opening to port G as the piston moves down and as the piston reaches bottom dead-center, port G is open and the exhaust escapes through port G.

As the piston moves up from bottom dead-center, it just closes port G, on left side of drawing where chamber 10 is, and the area above and below the piston, are open to each other so that for FIG. 6 air moves from below the piston to the combustion chamber above the piston, and for FIG. 7 a combined air-fuel mixture moves from below the piston to the combustion chamber above the piston.

When both port G and feeding chamber 10 are closed, the compression cycle begins, and the procedure repeats itself.

The reason port G is closed and chamber 10 is open is that the unburned combustion products are scavenged through chamber 10 and then eventually out through port G when port G opens on its next upward movement.

Tube 69 (see FIG. 5) which is contained within conduit 144 is intended to lubricate the piston.

The engine is lubricated by means of oil passageways provided in the piston rods and through openings leading to the rings. Oil is moved through components through passageways which move out through openings (or weepholes) and this lubricates the engine. Drippings are collected at the bottom, filtered and recirculated.

While there has been shown what is considered to be the preferred embodiments of the invention, it will be obvious to those skilled in the art that various changes and modifications may be made therein without departing from the scope of the invention.

What is claimed is:

1. In a rotary internal combustion engine, having:

a plurality of radially aligned cylinders collectively supported in a housing for common rotation about a first axis a piston block including a piston for each said cylinder slidable within each said cylinder, said piston block being rotatable about a second axis displaced from and parallel to said first axis;

slide means coupled with said plurality of radially aligned cylinders;

means coupled with said slide means linking said cylinders with said piston block to rotate said cylinders and said pistons together while moving said cylinders transversely of said first axis for rotation of said cylinders and pistons together for producing reciprocal motion of said pistons in said cylinders;

an offset crank for each said cylinder;

a piston plate coupled for rotation with said piston block, one end of said offset crank being coupled with said piston plate; and a cylinder plate coupled for rotation with said cylinders, the other end of said offset crank being coupled with said cylinder plate whereby rotation of said cylinders and said cylinder plate imparts rotation to said piston plate and said piston block.

2. In the engine of claim 1, wherein:

said slide means includes a slide for each said cylinder slidably coupling each cylinder to said housing; and said slide controls the movement of its associated cylinder about said second axis to maintain said cylinder and its associated piston perpendicular thereto for each position of said cylinder and said piston as said cylinders and said pistons rotate together.

3. In the engine of claim 1, wherein each said offset crank includes a pair of offsets, one at each end, the spacing between said pair of offsets being the same as the spacing between said first and said second axes, all of said offsets having their own central axis and the axis of each said pair of offsets lying in the same plane and being parallel to the plane of said first and said second axes.

4. In the engine of claim 1, including an offset shaft member having a first and a third portion coaxial with said first axis, and a second portion coaxial with said second axis and forming a central portion between said first and said third portions;

said linking means including said cylinder plate comprising a first pair of plates rotatably coupled to said first and said third portions of said offset shaft member, and said piston plate comprising a second pair of plates coupled with said second portion of said offset shaft member; and each said offset crank having one end rotatably connected with one of said first plates and the other end rotatably connected with one of said second plates.

5. In the engine of claim 4, including a power output shaft fixed to one of said first pair of plates and being rotatable therewith and operatively rotatably supported on said third portion of said shaft member, the other of the first pair of plates being rotatably supported on the first portion of said shaft member, and said second pair of plates being rotatably supported on said central portion.

6. In the engine of claim 1, including a deflector at an outlet from said cylinders for directing exhaust gases to the blades of a turbocharger.

7. In the engine of claim 1, including a turbocharger having a combustion products inlet coupled to a combustion products outlet from said cylinders.

8. In a rotary internal combustion engine, having:

a plurality of radially aligned cylinders collectively supported for common rotation about a first axis;

a piston block including a piston for each said cylinder slidable within each said cylinder, and said piston block being rotatable about a second axis;

means linking the cylinders with said piston block to rotate said cylinders and said pistons together while moving said cylinders transversely of said first axis for rotation of said cylinders and pistons together for producing reciprocal motion of said pistons in said cylinders; and each said piston having a central axis normal to said second axis and each said cylinder having a central axis coaxial with the piston central axis; and said linking means including pivotal linkage mechanism for maintaining the cylinder axis coaxial with the piston axis during rotation of said cylinders and said pistons about said first axis and said second axis, respectively.

9. In the engine of claim 8, including:

an offset shaft having first and third portions having a first shaft axis spaced from said first-mentioned axis and a second portion having a second shaft axis coaxial with said first-mentioned axis, said first and said second axes being parallel to each other; and said linking means including:

a slide guide for each said cylinder slidably coupling each cylinder for sliding movement, and a pair of spaced cylinder plates rotatably coupled to said first and said third portions of said shaft and being connected with said slide guide, whereby said slide guide controls the movement of said cylinder about said first axis.

10. In the engine of claim 9, including:

an off-set crank for each said cylinder;

a piston plate coupled to said piston block and with one end of said off-set crank; and a cylinder plate coupled for rotation with said cylinders for sliding thereof along said slide guides and coupled with the other end of said off-set crank.

11. In the engine of claim 10, wherein:

each said off-set crank includes a pair of offsets, one at each end; and the spacing between said offsets being the same as the spacing between said first and said second axes.

12. In the engine of claim 9, wherein:

said linking means includes a pair of links for each said cylinder, each link having one end operatively connected with its associated cylinder and the other end pivotally connected with said piston block; and the links connecting diametrically opposed cylinders being in alignment such that the axes of the cylinders coincide.

13. The engine of claim 10, including a power output shaft fixed to one of a first pair of plates forming said cylinder plate and being rotatable therewith and operatively rotatably supported on said third portion of said shaft member, the other of the first pair of plates being rotatably supported on the first portion of said shaft member, and a second pair of plates forming said piston plate being rotatably supported on said central portion.

14. In the engine of claim 11, including a power output shaft fixed to said cylinder plate and being rotatable therewith and operatively rotatably supported on said third portion of said shaft member, and said piston plate being rotatably supported on said second portion.

15. In the engine of claim 13, wherein said shaft member includes a fuel passageway and an air outlet therefrom coupled to an inlet for feeding fuel to said cylinders.

16. In the engine of claim 8, wherein said means linking said cylinders and said pistons together link said cylinders and said pistons together for all movements of said pistons and said cylinders.

17. In a rotary internal combustion engine, having:

a plurality of radially aligned cylinders collectively supported for common rotation about an offset shaft with two end portions and a central portion, said end portions having a first axis passing therethrough and a second axis passing through said central portion;

a piston block including a piston fixed thereto for each said cylinder and slidable within each said cylinder, said piston block being supported for rotation about said second axis which is displaced from and parallel to said first axis;

means operatively linking said cylinders with said piston block for rotation of said cylinders together with said pistons and said piston block such that a central axis of each of said cylinders passes through said second axis while moving said cylinders transversely of said first axis during rotation of said cylinders and pistons together thereby producing relative reciprocal motion of each piston with respect to its associated cylinder; and said linking means including first plate means coupled with said end portions for rotation thereabout, and links for each said cylinder, each having one end operatively connected with a cylinder and the other end pivotally connected with said plate means.

18. In the engine of claim 17, said first plate means including a first pair of plates rotatably coupled to said end portions of said offset shaft;

a second pair of plates fixedly coupled with said central portion of said shaft between said first and second portions coaxial with said second axis;

cranks each having one end rotatably connected with said first pair of plates and another end coupled with said second pair of plates for rotating said first pair of plates in response to rotation of said second pair of plates; and links each having one end pivotally connected to said first pair of plates and its other end connected with one of said cylinders for movement of said cylinders with said central axis thereof passing through and perpendicular to said second axis.

19. In the engine of claim 18, including a power output shaft connected with one of said first pair of plates and having an axis coaxial with said first axis.

20. In the engine of claim 18, including a housing and said shaft being coupled with said housing for supporting said piston block, conduit means in said shaft, a fuel supply inlet to said conduit means, and means connecting the air exhaust from said turbocharger to said conduit means for combining air exhausted from the turbocharger air exhaust with the fuel in said conduit means.

* * * * *